US011354961B2

(12) United States Patent
Rydkin

(10) Patent No.: US 11,354,961 B2
(45) Date of Patent: Jun. 7, 2022

(54) BODY-WORN DEVICE FOR CAPTURING USER INTENT WHEN INTERACTING WITH MULTIPLE ACCESS CONTROLS

(71) Applicant: CARRIER CORPORATION, Palm Beach Gardens, FL (US)

(72) Inventor: Maxim Rydkin, Penfield, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/486,010

(22) PCT Filed: Dec. 14, 2017

(86) PCT No.: PCT/US2017/066249
§ 371 (c)(1),
(2) Date: Aug. 14, 2019

(87) PCT Pub. No.: WO2018/160254
PCT Pub. Date: Sep. 7, 2018

(65) Prior Publication Data

US 2020/0051352 A1 Feb. 13, 2020

Related U.S. Application Data

(60) Provisional application No. 62/464,660, filed on Feb. 28, 2017.

(51) Int. Cl.

| | |
|---|---|
| ***G07C 9/00*** | (2020.01) |
| ***G07C 9/28*** | (2020.01) |
| ***G07C 9/27*** | (2020.01) |

(52) U.S. Cl.
CPC ..... *G07C 9/28* (2020.01); *G07C 9/00309* (2013.01); *G07C 9/00571* (2013.01); *G07C 9/00896* (2013.01); *G07C 9/27* (2020.01)

(58) Field of Classification Search
CPC ..... G07C 9/00896; G07C 9/00309; G07C 9/00571; G07C 9/25; G07C 9/26;
(Continued)

(56) References Cited

U.S. PATENT DOCUMENTS

| | | | |
|---|---|---|---|
| 8,994,498 | B2 | 3/2015 | Agrafioti et al. |
| 9,407,634 | B2 | 8/2016 | Martin et al. |

(Continued)

FOREIGN PATENT DOCUMENTS

| | | | |
|---|---|---|---|
| CN | 103943106 | A | 7/2014 |
| CN | 104036178 | A | 9/2014 |

(Continued)

OTHER PUBLICATIONS

Nuwer, Rachel, "Wristband Unlocks Your Devices with Your Heartbeat", Technology News, Sep. 3, 2013.

(Continued)

*Primary Examiner* — Yong Hang Jiang
(74) *Attorney, Agent, or Firm* — Bachman & LaPointe, P.C.

(57) ABSTRACT

A method to determine user intent for an access control including sensing biometrics data from a body-worn device; sensing biometrics data at an access control; comparing the biometrics data from the body-worn device and the access control; and determining a user intent to access the access control in response to the comparing.

20 Claims, 2 Drawing Sheets

(58) Field of Classification Search
CPC ..... G07C 9/28; G07C 9/29; G07C 9/00103; G07C 9/00111; G07C 9/27
See application file for complete search history.

(56) References Cited

U.S. PATENT DOCUMENTS

| | | | | |
|---|---|---|---|---|
| 10,152,584 | B2 | 12/2018 | Einberg | |
| 2004/0257267 | A1* | 12/2004 | Mafune | G01S 13/88 342/107 |
| 2007/0013476 | A1 | 1/2007 | Petrovic | |
| 2007/0050618 | A1 | 3/2007 | Roux et al. | |
| 2007/0063816 | A1 | 3/2007 | Murakami et al. | |
| 2008/0019578 | A1* | 1/2008 | Saito | G06K 19/07 382/124 |
| 2013/0027180 | A1* | 1/2013 | Lakamraju | G07C 9/257 340/5.53 |
| 2013/0127591 | A1* | 5/2013 | Shay | G07C 9/28 340/5.52 |
| 2014/0028439 | A1 | 1/2014 | Lien | |
| 2014/0085050 | A1* | 3/2014 | Luna | G07C 9/257 340/5.82 |
| 2014/0148709 | A1 | 5/2014 | Gu et al. | |
| 2014/0188770 | A1 | 7/2014 | Agrafioti et al. | |
| 2014/0282878 | A1* | 9/2014 | Ignatchenko | H04L 63/08 726/3 |
| 2015/0135310 | A1 | 5/2015 | Lee | |
| 2015/0141076 | A1 | 5/2015 | Libin et al. | |
| 2015/0178532 | A1 | 6/2015 | Brulé | |
| 2015/0187153 | A1* | 7/2015 | Davis | G07C 9/25 340/5.52 |
| 2015/0288687 | A1* | 10/2015 | Heshmati | G07C 9/257 726/7 |
| 2016/0135708 | A1* | 5/2016 | Chakravarthy | A61B 5/0006 600/515 |
| 2016/0165442 | A1 | 6/2016 | Shi et al. | |
| 2019/0172281 | A1* | 6/2019 | Einberg | G07C 9/00563 |
| 2020/0100108 | A1* | 3/2020 | Everson | H04L 9/0894 |

FOREIGN PATENT DOCUMENTS

| | | | |
|---|---|---|---|
| CN | 104688206 | A | 6/2015 |
| WO | 2015157083 | A1 | 10/2015 |
| WO | 2016087541 | A1 | 6/2016 |
| WO | 2016114012 | A1 | 7/2016 |

OTHER PUBLICATIONS

Nymi.com; Nymi band in the workplace.
Nymi.com; "Take control of your world".
International Search Report, dated Mar. 19, 2018, for PCT/US2017/066249.

* cited by examiner

BODY-WORN DEVICE FOR CAPTURING USER INTENT WHEN INTERACTING WITH MULTIPLE ACCESS CONTROLS

BACKGROUND

The present disclosure relates generally to access control systems, and more particularly, to a system and a method to identify user intent with biometric markers.

Various mobile devices have been utilized to open locks via a 'beam' to the lock, which provides directionality, or a 'push the button' on the box to wake up the lock for subsequent communication over Bluetooth. With the capability present in Bluetooth Low Energy (BTLE) to communicate with very low power, such system architectures permit the lock to be 'always on' and sending periodic BTLE advertisements, such as once per second. In environments where there are multiple locks within range of the mobile device such as in a hotel, each user may receive the advertisement from a significant number of locks, thereby complicating the determination of user intent.

Oftentimes, it may be difficult to determine which secured object wireless access control systems such as multiple side-by-side doors, or different sides of the same door when multiple objects are within wireless range. Also, when multiple users are attempting access to adjacent doors, it may be difficult to determine which user wants to access which door.

SUMMARY

A method to determine user intent for an access control according to one disclosed non-limiting embodiment of the present disclosure can include sensing biometrics data from a body-worn device; sensing biometrics data at an access control; comparing the biometrics data from the body-worn device and the access control; and determining a user intent to access the access control in response to the comparing.

A further embodiment of the present disclosure may include that the biometrics data is associated with at least one of heart rate, skin temperature, eye movements, and sudden bodily movements.

A further embodiment of the present disclosure may include that the access control is a door lock.

A further embodiment of the present disclosure may include that the mobile device is a smartphone.

A further embodiment of the present disclosure may include synchronizing the biometrics data to a globally synchronized time.

A further embodiment of the present disclosure may include communicating the biometrics data from the body-worn device and the access control to an access control system.

A further embodiment of the present disclosure may include that the body-worn device is at least one of an exercise band, a smart phone, a watch, and eyeglasses.

An access control system according to one disclosed non-limiting embodiment of the present disclosure can include an access control with a biometric marker sensor operable to sense biometrics data; a body-worn device operable to sense biometrics data; and an access control system operable to compare the biometrics data from the body-worn device and the access control to determine a user intent to access the access control in response to the comparing.

A further embodiment of the present disclosure may include that the body-worn device is a watch.

A further embodiment of the present disclosure may include that the body-worn device is an exercise band.

A further embodiment of the present disclosure may include that the biometrics data is associated with at least one of heart rate, skin temperature, eye movements, and sudden bodily movements.

An access control system according to one disclosed non-limiting embodiment of the present disclosure can include a multiple of access controls, each of the multiple of access controls having a biometric marker sensor operable to sense biometrics data; a mobile device in communication with the multiple of access controls, a body-worn device operable to sense biometrics data; an access control system operable to compare the biometrics data from the body-worn device and the access control to determine a user intent to access one of the multiple of access controls in response to the comparing.

A further embodiment of the present disclosure may include that the body-worn device is operable to communicate with the access control system via the mobile device.

A further embodiment of the present disclosure may include that the body-worn device is operable to communicate with each of the multiple of access controls.

A further embodiment of the present disclosure may include that the body-worn device is operable to communicate with the access control system.

A further embodiment of the present disclosure may include that the body-worn device is a watch.

A further embodiment of the present disclosure may include that the body-worn device is an exercise band.

A further embodiment of the present disclosure may include that the biometrics data is associated with a heart rate.

A further embodiment of the present disclosure may include that the biometrics data is associated with a skin temperature.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
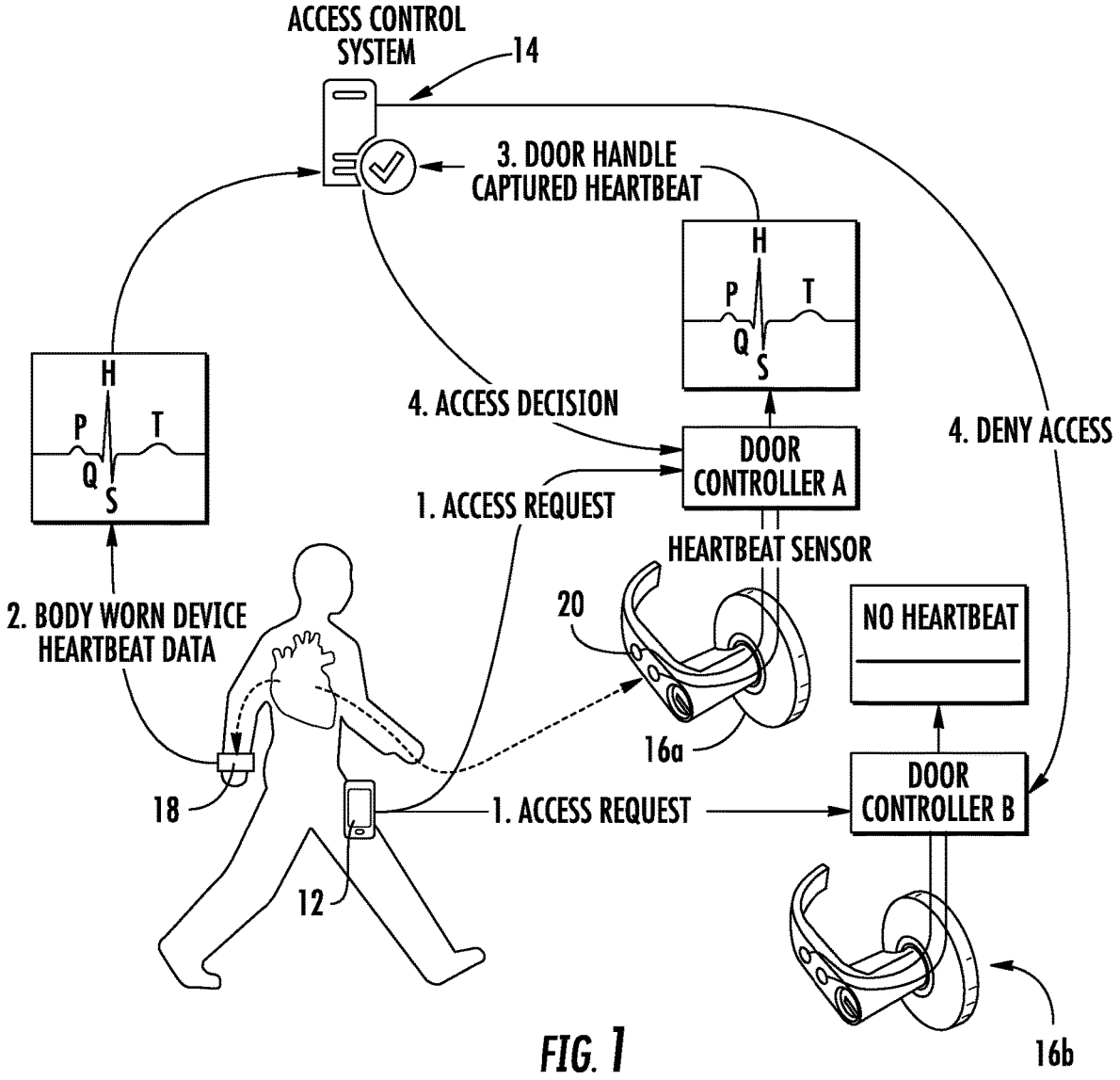
FIG. 1 is a general schematic system diagram of a user authentication system.

FIG. 1 schematically illustrates an access control system 10. The system 10 generally includes a mobile device 12, an access control system 14, a plurality of access controls 16, schematically illustrated as 16*a*, 16*b*, . . . , 16*n*, and a body-worn device 18. It should be appreciated that, although particular systems are separately defined in the schematic block diagrams, each or any of the systems may be otherwise combined or separated via hardware and/or software.

The mobile device 12 is a wireless capable handheld device such as a smartphone that is operable to communicate with the access control system 14 and the access controls 16. The access control system 14 may provide credentials and other data to the mobile device 12, such as firmware or software updates to be communicated to one or more of the access controls 16. Although the access control system 14 is depicted herein as a single device, it should be appreciated that the access control system 14 may alternatively be embodied as a multiplicity of systems, from which the mobile device 12 receives credentials and other data.

Each access control 16 is a wireless-capable, restricted-access, or restricted-use device such as wireless locks, access control readers for building entry, electronic banking controls, data transfer devices, key dispenser devices, tool dispensing devices, and other restricted-use machines. The mobile device 12 submits credentials to the access controls 16, thereby selectively permitting a user to access or activate functions of the access controls 16. A user may, for example, submit a credential to an electromechanical lock to unlock it, and thereby gain access to a restricted area. In another example, a user may submit a credential to an electronic banking control to withdraw funds. In still another example, the user may submit the credential to a unit that dispenses key cards with data associated with or data retrieved from the credential. The mobile device 12 may store credentials for one or all or other of the examples noted above, and in addition may store a plurality of credentials for each type of application at the same time. Some credentials may be used for multiple access controls 16. For example, a plurality of electronic locks in a facility may respond to the same credential. Other credentials may be specific to a single access control 16.

Each access control 16 also includes a biometric marker sensor 20 that is operable to identify biometric markers or "biomarkers" of the user when the user touches, or is adjacent to, the associated access control 16. Biometric markers or "biomarkers" may be measured and evaluated to observe biometric processes, pathogenic processes, or other responses. Example biometric markers include, but are not limited to, heart rate, skin temperature, eye movements, sudden bodily movements, and/or others.

The body-worn device 18 includes, but is not limited to, an exercise band, a smart phone, a watch, eyeglasses, or another such device that is typically carried or worn and also has the ability to identify biomarkers of the user. The body-worn device 18 is in communication with the access control system 14 either directly or through the mobile device 12. The body-worn device 18 may receive credentials form the access control system 14 either directly from the access control system 14 or may communicate with the mobile device 12 to communicate biomarkers of the user to the access control system 14.

Figure 2:
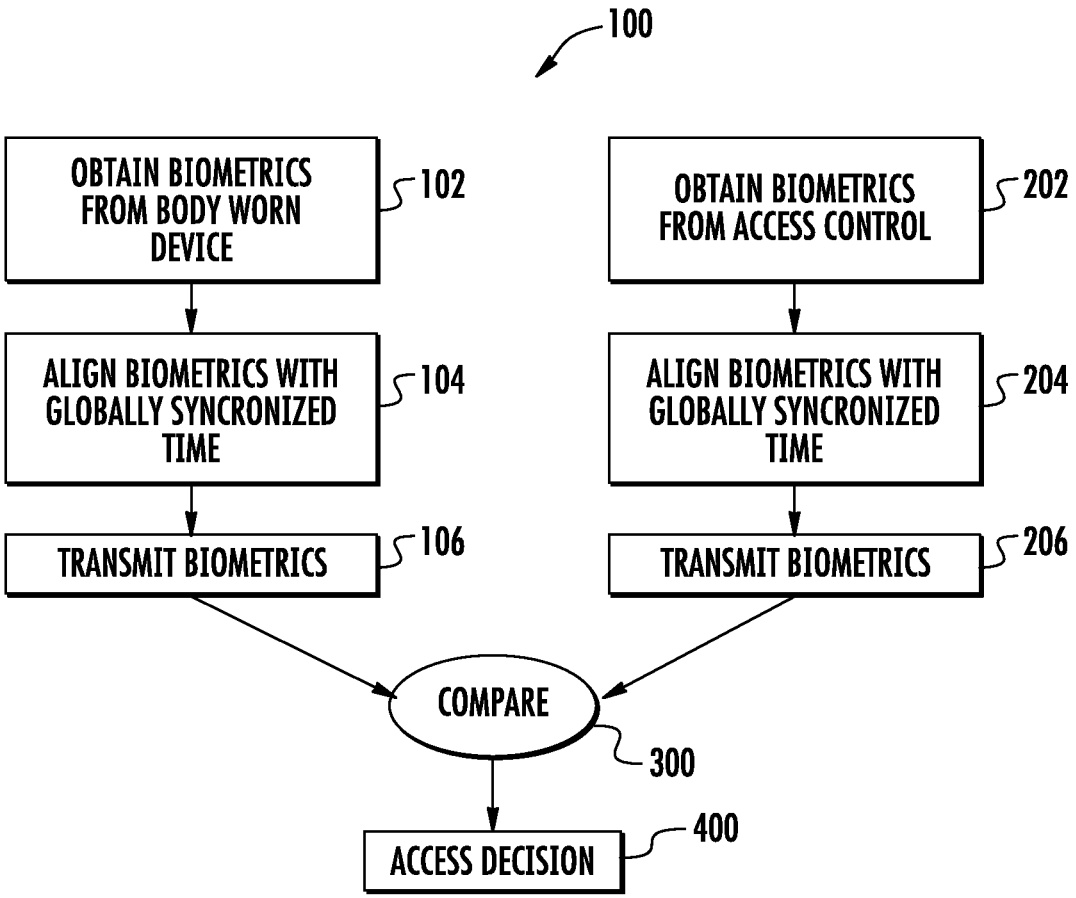
FIG. 2 is a flowchart of the user authentication system according to one disclosed non-limiting embodiment.

With reference also to FIG. 2, a method 100 to determine user intent initially includes usage of biometrics data from the body-worn device 18. For example, the body-worn device 18 senses a user's heartbeat data (step 102). The user's heartbeat biometric data may then be aligned to a globally synchronized time (step 104) either prior or once the data is transmitted to the access control system 14 (step 106). That is, the user's heartbeat biometric data may be communicated to the access control system 14 either directly, or through the mobile device 12. The access control system 14 may then align the data to a globally synchronized time.

Generally simultaneously, as the user places their hand on the biometric marker sensor 20 in the access control 16, the biometric marker sensor 20 likewise senses the user's heartbeat biometrics (step 202). The user's heartbeat biometric data is then aligned to the globally synchronized time (step 204) for transmission to the access control system 14 (step 206). Alignment of the data with the globally synchronized time provides for comparison therebetween. It should be appreciated that providing for alignment with a globally synchronized time may improve precision of the match, but may not be strictly necessary to and still obtain a "good enough" match. More generally, it may not be relevant for biometric types that don't change as rapidly as pulse.

The access control system 14 then evaluates the transmitted data from the body-worn device 18 and the biometric marker sensor 20 to determine user intent (step 300). That is, agreement between the heartbeat data from the body-worn device 18 and the biometric marker sensor 20 within a predetermined confidence permits operation of the access control 16A (step 400). Notably, as the user is not touching a locally adjacent access control 16B, to which the user also may have authority to access, the access request to the access control 16B is not authorized as no heartbeat data is sensed thereby.

Alternatively, the evaluation is performed by the access control 16, which communicates directly with the body-worn device 18 via the mobile device 12.

This system and method allows for transparent determination of user intent without a specific additional action being taken by the user other than placing their hand on the door handle which is and already expected step in opening the door.

The elements described and depicted herein, including in flow charts and block diagrams throughout the figures, imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, or any combination of these, and all such implementations may be within the scope of the present disclosure.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

The invention claimed is:

1. A method to determine user intent to access a particular access control, comprising:

sensing biometrics data from a body-worn device of a user;

sensing biometrics data at an access control via a biometric marker sensor;

communicating the biometrics data with an access control system from the body-worn device via a mobile device;

comparing the biometrics data from the body-worn device and the biometrics data of the access control after each are aligned to a globally synchronized time; and determining a user intent to access the particular access control from a plurality of locally adjacent access controls without a specific additional action being taken by the user other than physical contact with the access control in response to the comparing, wherein agreement between the biometrics data from the body-worn device and the biometric marker sensor within a predetermined confidence permits operation of the access control via credentials submitted to the access control from the mobile device.

2. The method as recited in claim 1, wherein the biometrics data is associated with at least one of heart rate, skin temperature, eye movements, and sudden bodily movements.

3. The method as recited in claim 1, wherein the mobile device is a smartphone.

4. The method as recited in claim 1, further comprising communicating the biometrics data from the body-worn device and the access control to an access control system.

5. The method as recited in claim 1, wherein the body-worn device is at least one of an exercise band, a smart phone, a watch, and eyeglasses.

6. An access system, comprising:

an access control with a biometric marker sensor operable to sense biometrics data; and a body-worn device operable to sense biometrics data, wherein the biometrics data is associated with at least one of heart rate, skin temperature, eye movements, and sudden bodily movements of the user, the body-worn device operable to communicate with an access control system via a mobile device;

the access control system operable to compare the biometrics data from the body-worn device and the biometrics data from the access control to determine a user intent to access the particular access control from a plurality of locally adjacent access controls in response to the comparing without a specific additional action being taken by the user other than physical contact with a handle associated with the access control, wherein agreement between the biometrics data from the body-worn device and the biometric marker sensor within a predetermined confidence permits operation of the access control, via credentials submitted to the access control from the mobile device.

7. The system as recited in claim 6, wherein the body-worn device is a watch.

8. The system as recited in claim 6, wherein the body-worn device is an exercise band.

9. An access system, comprising:

a multiple of locally adjacent access controls, each of the multiple of locally adjacent access controls having a biometric marker sensor operable to sense biometrics data of a user;

a body-worn device operable to sense biometrics data of the user, the body-worn device operable to communicate with an access control system via a mobile device, the access control system operable to compare the biometrics data from the body-worn device and the biometrics data from the access control after each are aligned to a globally synchronized time to determine a user intent to access one of the multiple of locally adjacent access controls in response to the comparing without a specific additional action being taken by the user other than physical contact with a handle of the access control, wherein agreement between the biometrics data from the body-worn device and the biometric marker sensor within a predetermined confidence permits operation of the access control via credentials submitted to the access control from the mobile device.

10. The system as recited in claim 9, wherein the body-worn device is operable to communicate with the access control system via the mobile device.

11. The system as recited in claim 9, wherein the body-worn device is operable to communicate with each of the multiple of access controls.

12. The system as recited in claim 9, wherein the body-worn device is operable to communicate with the access control system.

13. The system as recited in claim 9, wherein the body-worn device is a watch.

14. The system as recited in claim 9, wherein the body-worn device is an exercise band.

15. The system as recited in claim 9, wherein the biometrics data is associated with a heart rate.

16. The system as recited in claim 9, wherein the biometrics data is associated with a skin temperature.

17. The method as recited in claim 1, wherein the biometrics data is heartbeat data.

18. The method as recited in claim 1, wherein the biometrics data is heart rate.

19. The method as recited in claim 1, wherein the plurality of locally adjacent access controls comprise a multiple of side-by-side doors.

20. The method as recited in claim 1, wherein as the user is not touching a locally adjacent access control the access request to that access control is not authorized.

* * * * *